US007014125B2

(12) United States Patent
Lerner

(10) Patent No.: US 7,014,125 B2
(45) Date of Patent: Mar. 21, 2006

(54) SPRINKLERS

(75) Inventor: Micael Lerner, Tal-Shachar (IL)

(73) Assignee: Naan- Dan Irrigation Systems (C.S) Ltd., Naan (IL)

( * ) Notice: Subject to any disclaimer, the term of this patent is extended or adjusted under 35 U.S.C. 154(b) by 0 days.

(21) Appl. No.: 10/476,082

(22) PCT Filed: Apr. 22, 2002

(86) PCT No.: PCT/IL02/00320

§ 371 (c)(1),
(2), (4) Date: Mar. 22, 2004

(87) PCT Pub. No.: WO02/085529

PCT Pub. Date: Oct. 31, 2002

(65) Prior Publication Data

US 2004/0164177 A1 Aug. 26, 2004

(30) Foreign Application Priority Data

Apr. 22, 2001 (IL) ..... 142732

(51) Int. Cl.
*B05B 3/00* (2006.01)

(52) U.S. Cl. ..... 239/225.1; 239/232; 239/97; 239/222.11; 239/222.15; 239/222.17; 239/222.13; 239/251; 239/236; 239/DIG. 1

(58) Field of Classification Search ..... 239/225.1, 239/232, 97, 222.11, 222.15, 222.17, 222.21, 239/222.13, 251, 236, DIG. 1
See application file for complete search history.

(56) References Cited

U.S. PATENT DOCUMENTS 1,593,918 A 7/1926 Stanton
1,637,413 A * 8/1927 Elder ..... 239/222.15
2,025,267 A 12/1935 Buelna
2,220,275 A 11/1940 Preston
2,421,551 A 6/1947 Dunham
2,565,926 A 8/1951 Manning
2,582,158 A 1/1952 Porter
2,654,635 A * 10/1953 Aldo ..... 239/230
2,780,488 A * 2/1957 Kennedy ..... 239/97
2,962,220 A 11/1960 Woods
2,989,248 A 6/1961 Norland
3,117,724 A 1/1964 Ray
3,567,126 A 3/1971 Martini
3,583,638 A 6/1971 Eby et al.
3,727,842 A 4/1973 Ertsgaard
3,746,259 A * 7/1973 Apri ..... 239/229

(Continued)

FOREIGN PATENT DOCUMENTS

GB 846181 8/1960

*Primary Examiner*—David A. Scherbel
*Assistant Examiner*—James S. Hogan
(74) *Attorney, Agent, or Firm*—Abelman, Frayne & Schwab

(57) ABSTRACT

A rotary sprinkler (10) including a water inlet, a water outlet arranged for rotation about a rotation axis (14), a water director associated with the water outlet and a watering pattern determiner associated with at least one of the water outlets and the water director. The sprinkler (10) operates to cause the sprinkler (10) to have a substantially non-repeated watering pattern extending over more than 360 degrees about the rotation axis. The watering pattern is asymmetric with respect to the rotation axis (14) and is rotated for each successive rotation of the water outlet about the rotation axis (14) with respect to the watering pattern of the preceding rotation by a predetermined amount, whereby the successive rotations increase the angular uniformity of watering about the rotation axis.

14 Claims, 5 Drawing Sheets

U.S. PATENT DOCUMENTS 3,782,638 A 1/1974 Bumpstead
3,874,588 A 4/1975 Flynn
3,884,416 A * 5/1975 King ..... 239/97
3,930,618 A 1/1976 Lockwood
4,091,996 A 5/1978 Nelson
4,198,000 A 4/1980 Hunter
4,225,084 A 9/1980 Bals
4,277,029 A * 7/1981 Rabitsch ..... 239/232
4,376,513 A 3/1983 Hagar
4,398,666 A * 8/1983 Hunter ..... 239/222.13
4,453,673 A * 6/1984 Icenbice ..... 239/236
4,540,125 A 9/1985 Gorney
4,624,412 A 11/1986 Hunter
4,627,549 A 12/1986 Dudding
4,637,549 A * 1/1987 Schwartzman ..... 239/230
4,669,663 A * 6/1987 Meyer ..... 239/230
4,702,280 A 10/1987 Zakai et al.
4,754,925 A 7/1988 Rubinstein
4,773,595 A 9/1988 Livne
4,796,810 A 1/1989 Zakai
4,817,869 A 4/1989 Rubinstein
4,836,449 A 6/1989 Hunter
4,836,450 A 6/1989 Hunter
4,907,742 A * 3/1990 Whitehead et al. ..... 239/230
4,944,456 A 7/1990 Zakai
4,966,328 A 10/1990 Neeman
4,984,740 A * 1/1991 Hodge ..... 239/232
5,052,620 A * 10/1991 Rinkewich ..... 239/101
5,058,806 A 10/1991 Rupar
RE33,823 E 2/1992 Nelson et al.
5,172,864 A 12/1992 Spencer
5,192,024 A 3/1993 Blee
5,238,188 A * 8/1993 Lerner et al. ..... 239/230
5,372,307 A 12/1994 Sesser
5,544,814 A 8/1996 Spenser
5,647,541 A 7/1997 Nelson
5,762,269 A 6/1998 Sweet
5,971,297 A 10/1999 Sesser
6,016,972 A 1/2000 Kantor

* cited by examiner

SPRINKLERS

FIELD OF THE INVENTION

The present invention relates to sprinklers generally and more particularly to rotary sprinklers.

BACKGROUND OF THE INVENTION

A great variety of rotary sprinklers are known in the patent literature. The following U.S. patents are believed to represent the state of the art: U.S. Pat. Nos. 6,016,972; 5,971,297; 5,647,541; 5,544,814; 5,372,307; 5,192,024; 5,172,864; 5,058,806; 4,984,740; 4,966,328; 4,944,456; 4,836,450; 4,836,449; 4,817,869; 4,796,810; 4,773,595; 4,754,925; 4,702,280; 4,637,549; 4,627,549; 4,624,412; 4,398,666; 4,198,000; 3,874,588; 4,376,513; 3,930,618; 3,874,588; 3,782,638; 3,727,842; 3,583,638; 3,567,126; 3,117,724; 2,989,248; 2,962,220; 2,582,158; 2,565,926; 2,421,551; 2,025,267; 1,593,918; RE 33,823.

SUMMARY OF THE INVENTION

The present invention seeks to provide an improved rotary sprinkler.

There is thus provided in accordance with a preferred embodiment of the present invention a rotary sprinkler including:

a water inlet;

a water outlet arranged for rotation about a rotation axis;

a water director associated with the water outlet: and a watering pattern determiner associated with at least one of the water outlet and the water director and being operative to cause the sprinkler to have a substantially non-repeated watering pattern extending over more than 360 degrees about the rotation axis, which watering pattern is asymmetric with respect to the rotation axis, the asymmetric watering pattern being rotated for each successive rotation of the water outlet about the rotation axis with respect to the watering pattern of the preceding rotation by a predetermined amount, whereby successive rotations increase the angular uniformity of watering about the rotation axis.

There is also provided in accordance with a preferred embodiment of the present invention a rotary sprinkler including:

a water inlet;

a water outlet arranged for rotation about a rotation axis;

a water director associated with the water outlet: and a watering pattern determiner associated with at least one of the water outlet and the water director and being operative to cause the sprinkler to have a substantially non-repeated watering pattern extending over more than 180 degrees about the rotation axis, which watering pattern is asymmetric with respect to the rotation axis, the asymmetric watering pattern being rotated for each successive rotation of the water outlet about the rotation axis with respect to the watering pattern of the preceding rotation by a predetermined amount, whereby successive rotations increase the angular uniformity of watering about the rotation axis.

Preferably, the watering pattern has generally the same configuration for each successive rotation of the water outlet about the rotation axis.

Preferably, the water director includes a water deflector, which preferably is located downstream of the water outlet.

Alternatively, the water director may include a water outlet orientor.

As a further alternative, the water director may include a water flow obstructor.

In accordance with a preferred embodiment of the present invention, the substantially non-repeated watering pattern includes a single pattern portion of generally increasing sprinkling distance and a single pattern portion of generally decreasing sprinkling distance.

Preferably, the single pattern portion of generally increasing sprinkling distance extends from an overall minimum sprinkling distance to an overall maximum sprinkling distance.

Preferably, the single pattern portion of generally decreasing sprinkling distance extends from an overall maximum sprinkling distance to an overall minimum sprinkling distance.

BRIEF DESCRIPTION OF THE DRAWINGS

The present invention will be understood and appreciated more fully from the following detailed description, taken in conjunction with the drawings in which.

DETAILED DESCRIPTION OF A PREFERRED EMBODIMENT

Figure 1:
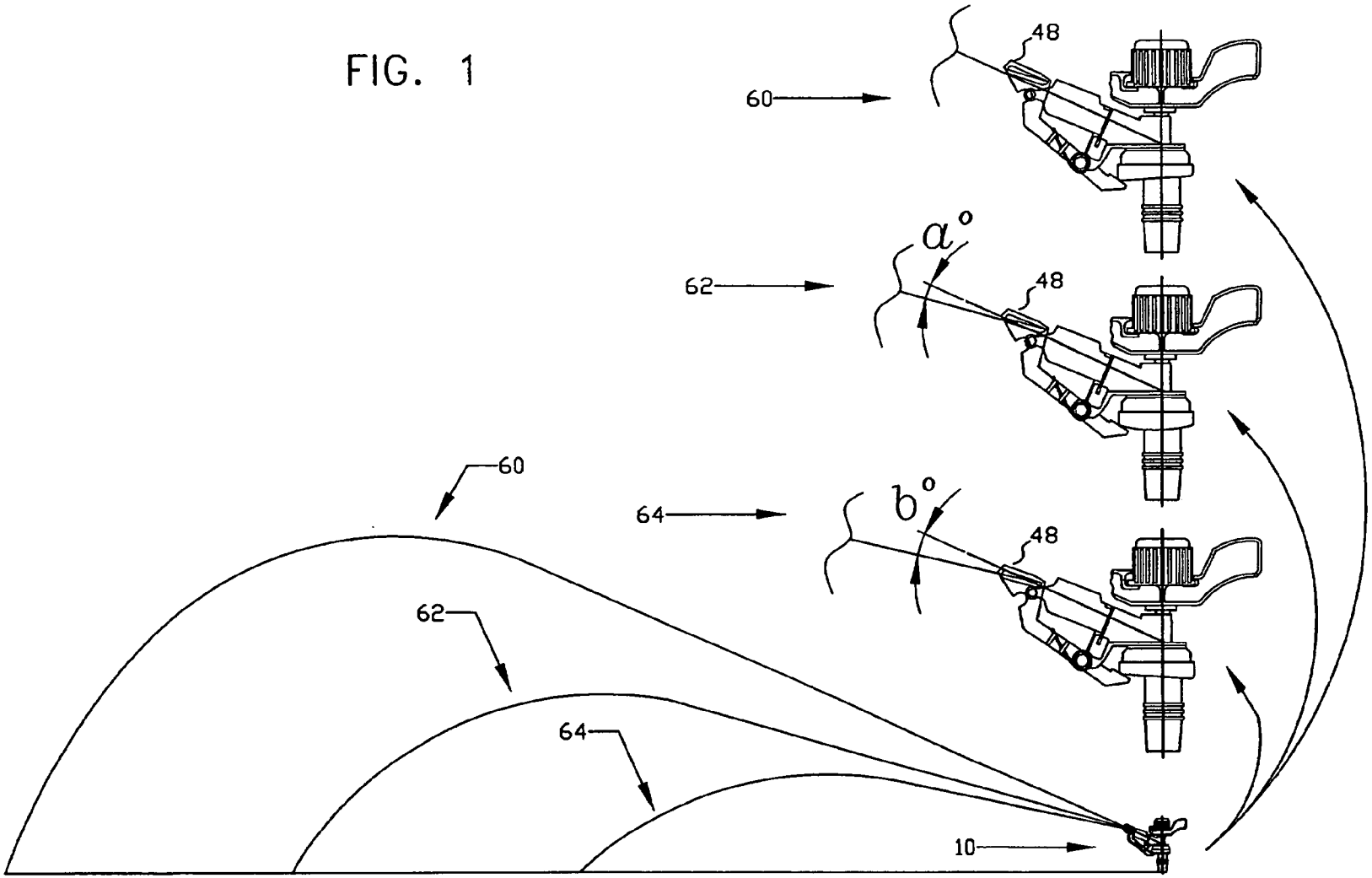
FIG. 1 is a simplified illustration of the operation of a sprinkler constructed and operative in accordance with a preferred embodiment of the present invention in three different operative orientations.
Figure 2:
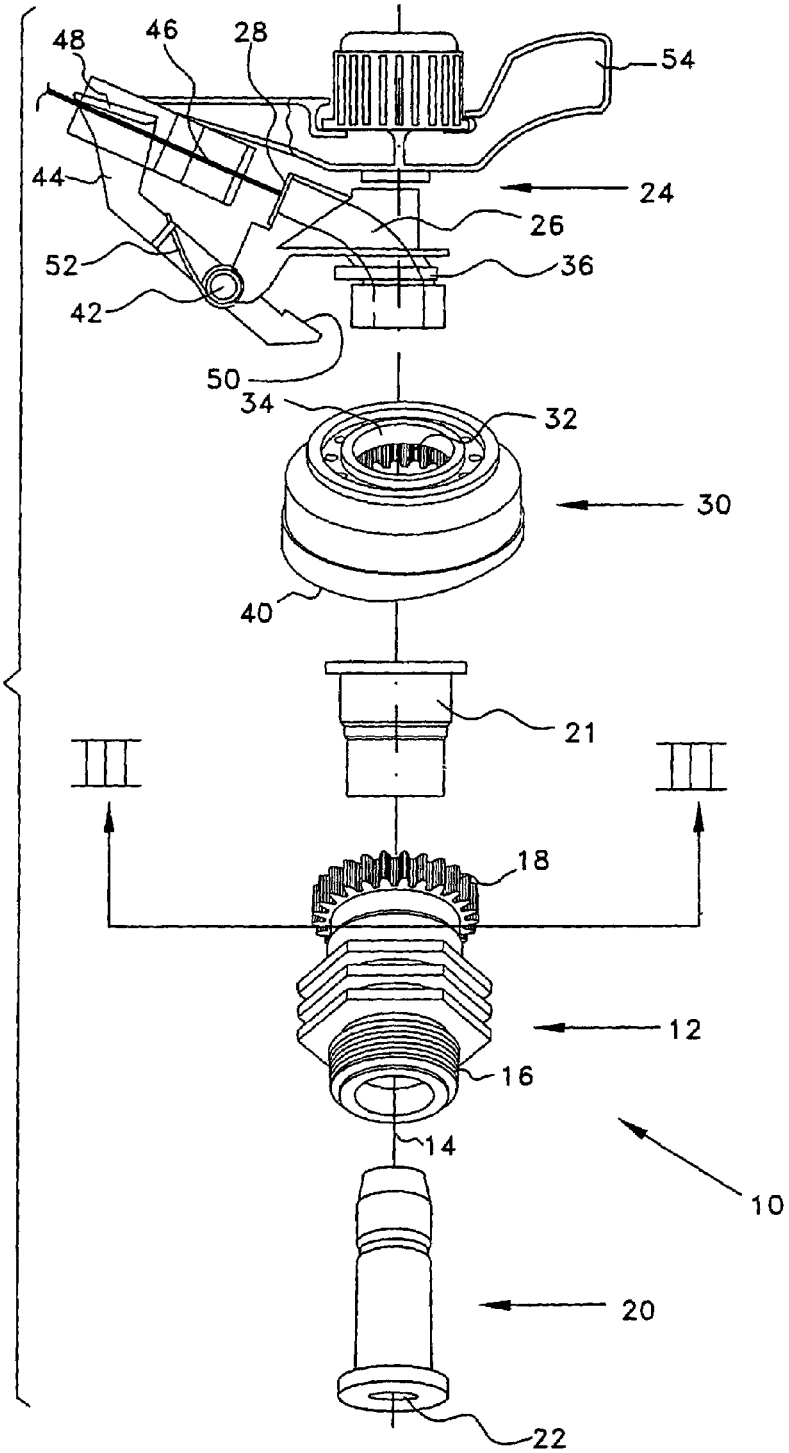
FIG. 2 is a simplified partially cut-away exploded view illustration of the sprinkler of FIG. 1.

Reference is now made to FIGS. 1 and 2, which are simplified illustrations of the structure and operation of a rotary sprinkler constructed and operative in accordance with a preferred embodiment of the present invention.

As seen in FIGS. 1 & 2, there is provided a rotary sprinkler, generally designated by reference numeral 10, which includes a generally cylindrical base portion 12, which defines an axis of rotation 14 for the sprinkler 10. Base portion 12 typically includes external threading 16 at a lower portion thereof and preferably also defines gear teeth 18 at a top portion thereof. Both threading 16 and gear teeth 18 are arranged symmetrically about axis of rotation 14.

Disposed within base portion 12 are water passageway elements 20 and 21 which are typically fixed together in coaxial arrangement by threaded engagement therebetween. Water passageway element 20 is formed with a lower opening 22, which defines a water inlet for sprinkler 10. Water passageway element 21 is fixedly coupled to sprinkler body 24, preferably by threaded engagement therebetween. Sprinkler body 24 preferably defines an internal water passage 26, which terminates in a nozzle 28. Nozzle 28 defines a water outlet from sprinkler 10, which is arranged for rotation about rotation axis 14.

A cam defining element 30 is preferably mounted for rotation about rotation axis 14. Cam defining element 30 is preferably provided with inwardly directed gear teeth 32, whose number is preferably greater than the number of gear teeth 18 on base portion 12. Cam defining element 30 thus rotates about rotation axis 14 in an eccentric manner, wherein the orientation of the cam defining element 30 relative to the base portion 12 is different for each successive 360 degree rotation of the cam defining element 30 about rotation axis 14.

Figure 3:
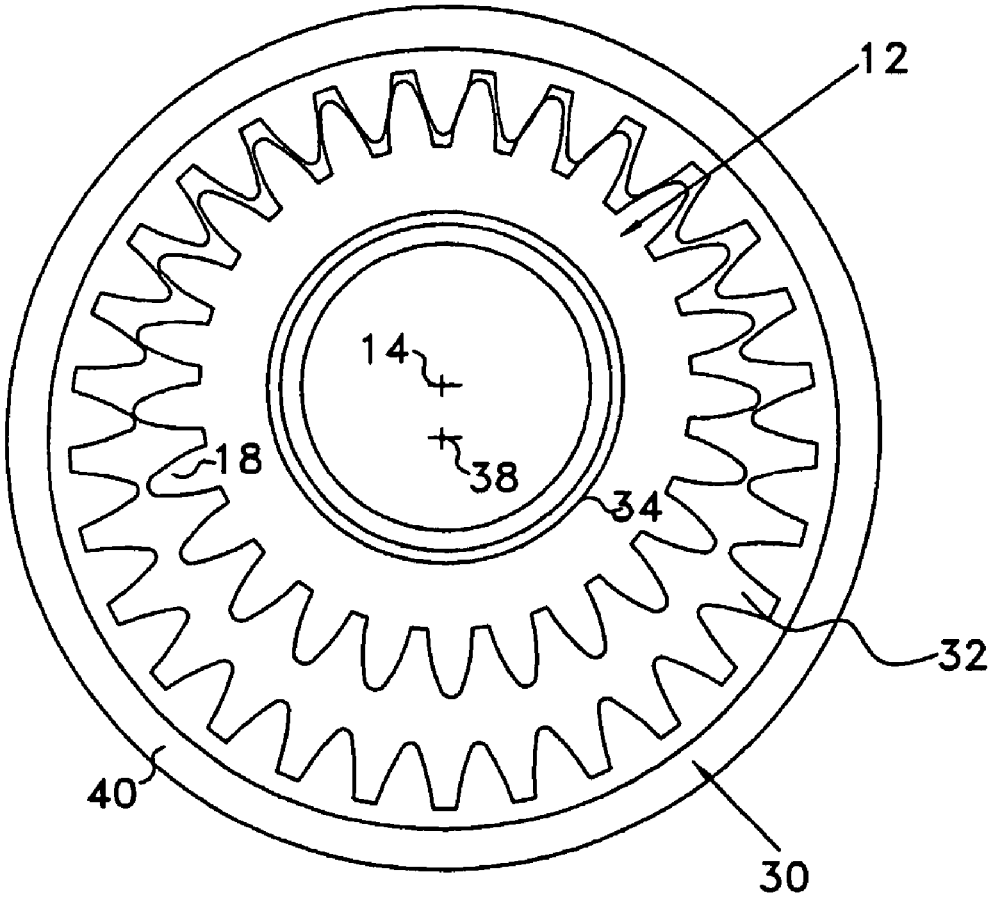
FIG. 3 is a simplified partial sectional illustration taken along the lines III—III in FIG. 2.

Reference is now made additionally to FIG. 3, which is a partial sectional illustration taken along the lines III—III in FIG. 2. As seen in FIGS. 2 and 3, cam defining element 30 also includes a rim 34, which rotatably engages a corresponding eccentric ring 36 mounted on or integrally formed with sprinkler body 24. Rim 34 and eccentric ring 36 are arranged symmetrically about an eccentric axis 38.

It may thus be appreciated that cam defining element 30 rotates about eccentric axis 38 and revolves in an eccentric manner about axis of rotation 14.

Cam defining element 30 defines a cam surface 40, which is non-uniform in an azimuthal sense, taken about rotation axis 14. Due to the eccentric rotation of the cam defining element 30 and the non 360 degree periodicity of its rotation about axis 14, the cam surface 40 rotates relative to the sprinkler body 24 as both rotate about rotation axis 14.

Pivotably mounted onto sprinkler body 24 about a pivot axis 42 is a deflector 44 which is arranged for intermittent engagement with a water stream 46 exiting nozzle 28 and defines a water director associated with the water outlet defined by nozzle 28. Deflector 44 preferably includes a water stream engagement portion 48, which is integrally formed with a cam surface engagement portion 50; Deflector 44 is preferably biased by a spring 52 about pivot axis 42 so that it engages cam surface 40 along most, if not all of the rotation of the sprinkler body 24 about axis of rotation 14.

Thus it may be appreciated that the orientation of cam surface 40 at the location where it is engaged by cam surface engagement portion 50, determines whether and to what extent the water stream engagement portion 48 engages the water stream 46 and thus determines the pattern of watering produced by sprinkler 10.

It is thus appreciated that the cam defining element 30 and more particularly the cam surface 40 thereof constitutes a watering pattern determiner which is preferably associated with the water outlet and the water director and is operative to cause the sprinkler to have a watering pattern extending over more than 360 degrees about the axis of rotation 14. It is thus appreciated that this water pattern is geographically substantially non-repeated in successive 360 degree rotations since it extends over more than 360 degrees.

It is noted that the above-described structure of the watering pattern determining is not the only possible structure thereof. The present invention also encompasses any suitable arrangement which provides a watering pattern which is asymmetric with respect to the axis of rotation 14 and which is rotated for each successive rotation of the water outlet about the axis of rotation 14 with respect to the watering pattern of the preceding rotation by a predetermined amount, whereby successive rotations increase the angular uniformity of watering about the axis of rotation. One possible alternative structure which provides the desired functionality of the present invention is the use of a water director, which changes the angle of output of a water stream from a nozzle.

Sprinkler 10 also preferably comprises a hammer 54, which intermittently engages the water stream 46 upstream of deflector 44 in a conventional manner.

Reference is now made to FIGS. 4A, 4B, 4C, 4D, 4E, 4F & 4G, which are simplified illustrations of the outer extent of a watering pattern produced by the sprinkler of FIGS. 1–3 in seven sequential identical rotations of the sprinkler body 24 about an axis of rotation 14 of the sprinkler body 24, the angular extent of each rotation being other than 360 degrees. In the illustrated embodiment, the angular extent of each rotation is approximately 410 degrees. It is appreciated that the angular extent of each rotation is determined by the ratio of the numbers of gear teeth 18 and 32 and may be greater or less than 360 degrees.

Figure 4A:
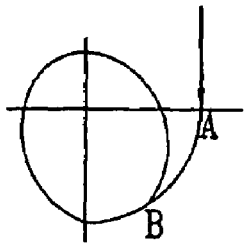
FIGS. 4A, 4B, 4C, 4D, 4E, 4F & 4G are simplified illustrations of the outer extent of a watering pattern produced by the sprinkler of FIGS. 1–3 in seven sequential identical rotations of a sprinkler head about an axis of rotation thereof, the angular extent of each rotation being other than 360 degrees.
Figure 4B:
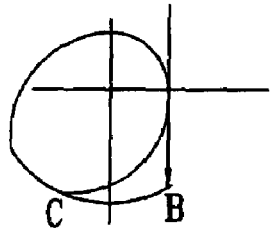
Figure 4C:
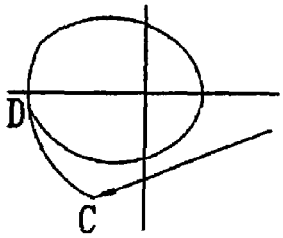
Figure 4D:
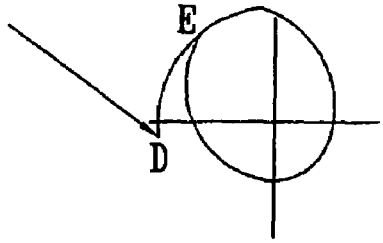
Figure 4E:
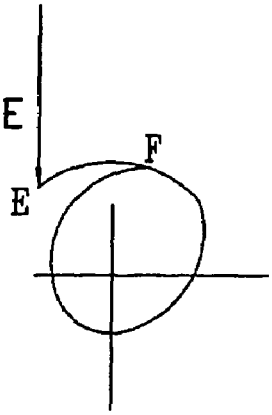
Figure 4F:
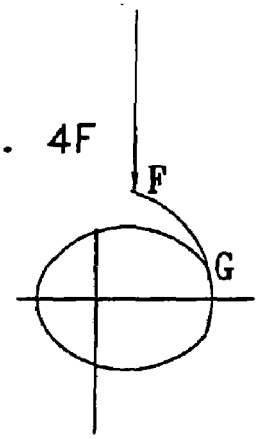
Figure 4G:
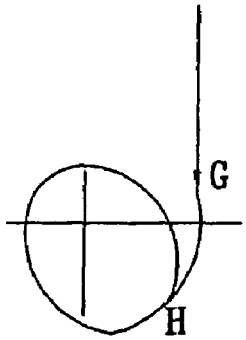

The arrow heads in each figure show the rotation commencement point for each rotation of the sprinkler body 24. For example, in FIG. 4A, the letter "A" denotes a starting point of the rotation. At the end of this rotation, the sprinkler body 24 typically reaches a point "B". In FIG. 4B, the sprinkler body 24 starts at the point "B" and typically ends its rotation at a point "C". In FIG. 4C, the sprinkler body 24 starts at the point "C" and typically ends its rotation at a point "D". In FIG. 4D, the sprinkler body 24 starts at the point "D" and typically ends its rotation at a point "E". In FIG. 4E, the sprinkler body 24 starts at the point "E" and typically ends its rotation at a point "F". In FIG. 4F, the sprinkler body 24 starts at the point "F" and typically ends its rotation at a point "G". In FIG. 4G, the sprinkler body 24 starts at the point "G" and typically ends its rotation at a point "H".

Figure 5:
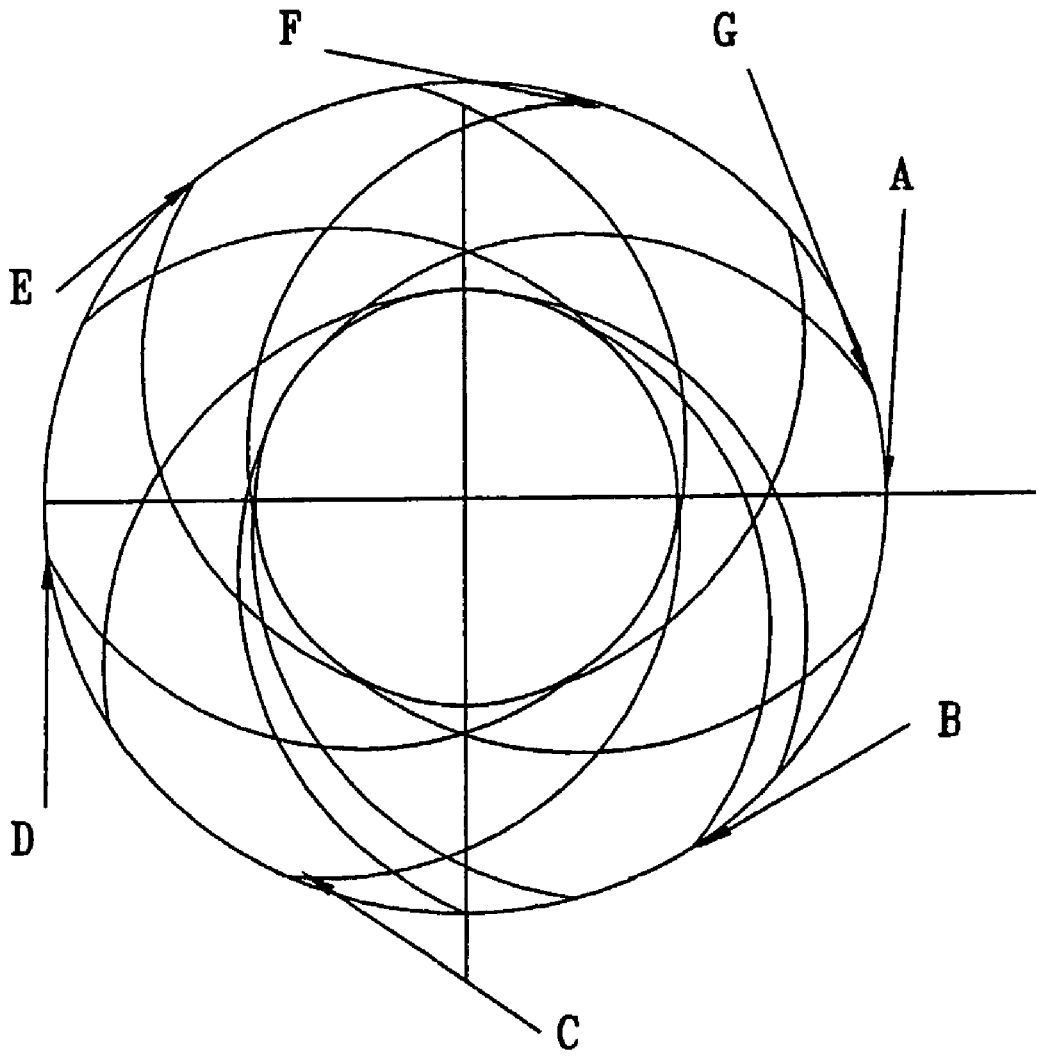
FIG. 5 is a composite illustration showing in overlay the outer extents of the watering pattern produced by the sprinkler of FIGS. 1–3 in the course of the seven rotations illustrated in FIGS. 4A–4G.

Reference is now made to FIG. 5, which shows a total watered area which is typically covered by the sprinkler body 24, seven sequential identical rotations shown in FIGS. 4A–4G, in accordance with the preferred embodiment of the present invention. The arrow heads in FIG. 5 relate to the starting locations of the sprinkler body 24, as denoted in FIGS. 4A–4F.

Reference is now made once again to FIG. 1 and additionally to FIG. 5, which is a composite illustration showing in overlay the outer extents of the watering pattern produced by the sprinkler of FIGS. 1–3 in the course of the seven rotations illustrated in FIGS. 4A–4G. It may be appreciated from a consideration of FIGS. 1 and 5 that rotation of cam surface 40 relative to sprinkler body 24 and thus relative to deflector 44 causes the extent of engagement of the deflector 44 with the water stream 46 at a given azimuthal position of the water stream about axis of rotation 14 to vary from rotation to rotation.

FIG. 1 shows three such extents of engagement. Reference numeral 60 shows an orientation of maximum sprinkling distance wherein deflector 44 is oriented such that the water stream engagement portion 48 thereof does not engage the water stream 46. Reference numeral 62 shows an orientation of intermediate sprinkling distance wherein deflector 44 is oriented such that the water stream engagement portion 48 thereof engages the water stream 46 at a first angle "a" with respect thereto. Reference numeral 64 shows an orientation of minimum sprinkling distance wherein deflector 44 is oriented such that the water stream engagement portion 48 thereof engages the water stream 46 at a second angle "b" with respect thereto.

It will be appreciated by persons skilled in the art that the present invention is not limited by what has been particularly shown and described hereinabove. Rather the scope of the present invention includes both combinations and subcombinations of the various features described hereinabove as well as variations and modifications which would occur to persons skilled in the art upon reading the specification and which are not in the prior art.

What is claimed is:

1. A rotary sprinkler comprising:

a water inlet;

a water outlet arranged for rotation about a rotation axis;

a water director associated with the water outlet: and a watering pattern determiner associated with at least one of the water outlet and the water director and being operative to cause the sprinkler to have a substantially non-repeated watering pattern extending over more than 360 degrees about said rotation axis, which watering pattern is asymmetric with respect to said rotation axis, said asymmetric watering pattern being rotated for each successive rotation of said water outlet about said rotation axis with respect to said watering pattern of the preceding rotation by a predetermined amount, whereby successive rotations increase the angular uniformity of watering about said rotation axis.

2. A rotary sprinkler according to claim 1 and wherein said watering pattern has generally the same configuration for each successive rotation of said water outlet about said rotation axis.

3. A rotary sprinkler according to claim 1 and wherein said water director comprises a water deflector.

4. A rotary sprinkler according to claim 3 and wherein said water deflector is located downstream of said water outlet.

5. A rotary sprinkler according to according claim 1 and wherein said substantially non-repeated watering pattern includes a single pattern portion of generally increasing sprinkling distance and a single pattern portion of generally decreasing sprinkling distance.

6. A rotary sprinkler according to claim 5 and wherein said single pattern portion of generally increasing sprinkling distance extends from an overall minimum sprinkling distance to an overall maximum sprinkling distance.

7. A rotary sprinkler according to claim 5 and wherein said single pattern portion of generally decreasing sprinkling distance extends from an overall maximum sprinkling distance to an overall minimum sprinkling distance.

8. A rotary sprinkler comprising:

a water inlet;

a water outlet arranged for rotation about a rotation axis;

a water director associated with the water outlet: and a watering pattern determiner associated with at least one of the water outlet and the water director and being operative to cause the sprinkler to have a substantially non-repeated watering pattern extending over more than 180 degrees about said rotation axis, which watering pattern is asymmetric with respect to said rotation axis, said asymmetric watering pattern being rotated for each successive rotation of said water outlet about said rotation axis with respect to said watering pattern of the preceding rotation by a predetermined amount, whereby successive rotations increase the angular uniformity of watering about said rotation axis.

9. A rotary sprinkler according to claim 8 and wherein said watering pattern has generally the same configuration for each successive rotation of said water outlet about said rotation axis.

10. A rotary sprinkler according to claim 8 and wherein said water director comprises a water deflector.

11. A rotary sprinkler according to claim 10 and wherein said water deflector is located downstream of said water outlet.

12. A rotary sprinkler according to claim 8 and wherein said substantially non-repeated watering pattern includes a single pattern portion of generally increasing sprinkling distance and a single pattern portion of generally decreasing sprinkling distance.

13. A rotary sprinkler according to claim 12 and wherein said single pattern portion of generally increasing sprinkling distance extends from an overall minimum sprinkling distance to an overall maximum sprinkling distance.

14. A rotary sprinkler according to claim 12 and wherein said single pattern portion of generally decreasing sprinkling distance extends from an overall maximum sprinkling distance to an overall minimum sprinkling distance.

* * * * *